US005116164A

United States Patent [19]

Casagrande

[11] Patent Number: 5,116,164

[45] Date of Patent: May 26, 1992

[54] DEVICE TO LOAD REINFORCEMENT RODS

[75] Inventor: Bruno Casagrande, Fontanafredda, Italy

[73] Assignee: Casagrande SpA, Fontanafredda, Italy

[21] Appl. No.: 598,135

[22] Filed: Oct. 16, 1990

[30] Foreign Application Priority Data

Oct. 26, 1989 [IT] Italy ..... 83495 A/89

[51] Int. Cl.[5] ..... E21D 19/00

[52] U.S. Cl. ..... 405/303; 173/176; 405/40; 405/45

[58] Field of Search ..... 405/303, 259, 146, 151, 405/152; 173/22, 23, 42, 43, 39, 46

[56] References Cited

U.S. PATENT DOCUMENTS

| | | | |
|---|---|---|---|
| 794,635 | 7/1905 | Moir | 405/151 X |
| 2,067,711 | 1/1937 | Killmer | 405/151 |
| 2,300,167 | 10/1942 | Osgood | 173/39 |
| 3,506,075 | 4/1970 | Attebo . | |
| 4,226,559 | 10/1980 | Prebensen | 405/303 |
| 4,473,325 | 9/1984 | Beney et al. | 405/303 |
| 4,785,892 | 11/1988 | Luen | 173/39 X |

FOREIGN PATENT DOCUMENTS

| | | | |
|---|---|---|---|
| 0130969 | 1/1985 | European Pat. Off. . | |
| 2842788 | 4/1980 | Fed. Rep. of Germany . | |
| 2402059 | 3/1979 | France . | |
| 648898 | 4/1985 | Switzerland . | |
| 0665096 | 5/1979 | U.S.S.R. | 405/303 |
| 0781361 | 11/1980 | U.S.S.R. | 405/303 |
| 2114027 | 8/1983 | United Kingdom | 405/303 |
| 2196884A | 5/1988 | United Kingdom . | |

*Primary Examiner*—Dennis L. Taylor
*Attorney, Agent, or Firm*—Nixon & Vanderhye

[57] ABSTRACT

Device (27) to load reinforcement rods, which is suitable to cooperate with an excavation equipment (14) in providing lengthwise reinforcements in tunnels, particularly in excavations of a great depth amounting to about twenty meters or more, the excavation equipment (14) being borne on an excavator machine (10) and being able to rotate by an angle "alpha" from one or the other of two lateral inactive positions (A-B), the excavation equipment (14) comprising a drilling head (19) suitable to cooperate alternately with drilling means (20) and with the rods (25), the device consisting of at least one movable arm means (29) connected (28) to the excavation equipment (14) and lodging shaped movable sector means (32) and shaped clamping means (33), both shaped means (32-33) being connected to second and third actuation means (35-38) for cooperation therewith and with the at least one movable arm means (29) in positioning, clamping and unclamping the drilling means (20) and the reinforcement rods (25), the at least one movable arm means (29) being connected to first actuation means (31) for cooperation with the drilling head (19) of the excavation equipment (14) in the movement of the drilling means (20) and reinforcement rods (25).

7 Claims, 9 Drawing Sheets

DEVICE TO LOAD REINFORCEMENT RODS

BACKGROUND OF THE INVENTION

1. Field of the Invention

This invention concerns a device to load reinforcement rods. To be more exact, the invention concerns a device suitable to cooperate with an excavation equipment in moving the drilling shaft before and after the drilling of a hole and in feeding on the excavation equipment the non-recoverable reinforcement rods employed in lengthwise reinforcements in tunnels.

2. Discussion of Prior Art

The device of the invention and the excavation equipment are normally carried on an excavation machine operating at the working face.

The state of the art includes various methods and devices employed in the reinforcement of tunnels.

One of the systems most often used consists in carrying out a series of lengthwise drillings about the vault of the tunnel.

At the end of each drilling step, which is carried out by means of suitable tools on a shaft, the shaft is withdrawn from the hole made in the tunnel wall and a cement agglomerate is injected into the hole.

Thereafter, a non-recoverable reinforcement rod, having a length substantially the same as that of the hole thus made, is inserted into the cement agglomerate so as to complete the reinforcement.

The cycle is repeated to make each hole, and therefore there is a continuous handling of the drilling shaft alternated from time to time with the feeding of new reinforcement rods for insertion into the holes made in the wall.

The action of drilling and inserting the rods is normally carried out by means of one and the same excavation equipment borne on an operating machine.

The operating machine brings the excavation equipment with the drilling shaft from time to time to the hole to be made. As each hole is made, the excavation equipment is normally withdrawn to one of its two lower positions at the sides of the machine, where the drilling shaft is removed by hand and the reinforcement rod to be inserted is fitted.

The excavation equipment is then brought back again to the hole made beforehand and filled in the meantime with the cement agglomerate.

When the reinforcement rod has been inserted, the excavation equipment is withdrawn once more to its position for the drilling shaft to be fitted, and the cycle is repeated in the same way for each hole to be made.

The operating steps described above entail a considerable use of manpower and very long times for execution.

Moreover, after the drilling, the excavation equipment is displaced for the reinforcement rod to be loaded and the subsequent positioning of the reinforcement rod on the drilling axis with the required accuracy becomes a problem.

The problems are worsened when it is realized that the drilling shafts and reinforcement rods may have a length of twenty metres or more.

SUMMARY OF THE INVENTION

The present applicant has set himself the objective of providing a device suitable to overcome the problems of the state of the art and of obtaining a plurality of other advantages.

The invention is set forth in the main claim, while the dependent claims describe various features of the invention.

The device to load reinforcement rods according to the invention is secured to the excavation equipment and is suitable to carry out the following working steps:

engagement of the drilling shaft when the latter has made a lengthwise hole in the working face;

the positioning of the drilling shaft in a parked position;

the placing of a reinforcement rod in a working position for insertion into the hole made beforehand and already filled with cement agglomerate;

the positioning of the drilling shaft in the working position to make a new hole;

the loading and placing of a new reinforcement rod in a parked position for insertion into the hole at the end of the step of casting the cement agglomerate.

The device of the invention is suitable to cooperate with a device to feed reinforcement rods, the latter device being included on the excavation equipment, and also with an operating machine, the latter device and the operating machine being the subject of parallel patent applications in the name of the present applicant.

The device of the invention consists of a support for connection to the excavation equipment and of a movable arm to support and displace the drilling shaft and the reinforcement rods.

The movable arm is conformed so as to cooperate with shaped sectors pivoted on the arm and actuated by suitable actuation means borne on the arm itself.

The reciprocal action of the movable arm and the shaped sectors enables a lodgement to be created from time to time for the drilling shaft and the reinforcement rods and the shaft and rods to be properly positioned for their loading into the drilling head.

The device of this invention may consist of one or more equal assemblies conformed as described above and suitably spaced apart along the excavation equipment. The number of assemblies included may depend on the length of the excavation equipment and therefore of the shafts and rods to be handled.

With the configuration of the device as described above it is possible to obtain a plurality of advantages, among which should be borne in mind:

the certainty of remaining on the same drilling axis during insertion of the relative reinforcement rod in the hole;

the cancellation of downtimes, especially if the excavation equipment comprises a drilling head equipped with a hammer rather than a mandrel (inability to insert the materials from the rear of the excavation equipment);

the reduction of any auxiliary equipment intended for the positioning of the reinforcement rods on the alignment guides included on the excavation equipment;

the better safety conditions for the labour force, which will not be required at the drilling face but only at the rear of the operating machine.

These and other special features of the invention will be made clearer in the description that follows.

BRIEF DESCRIPTION OF THE DRAWINGS

The attached figures, which are given as a non-restrictive example, show the following.

DETAILED DISCUSSION OF PREFERRED EMBODIMENTS

Figure 1:
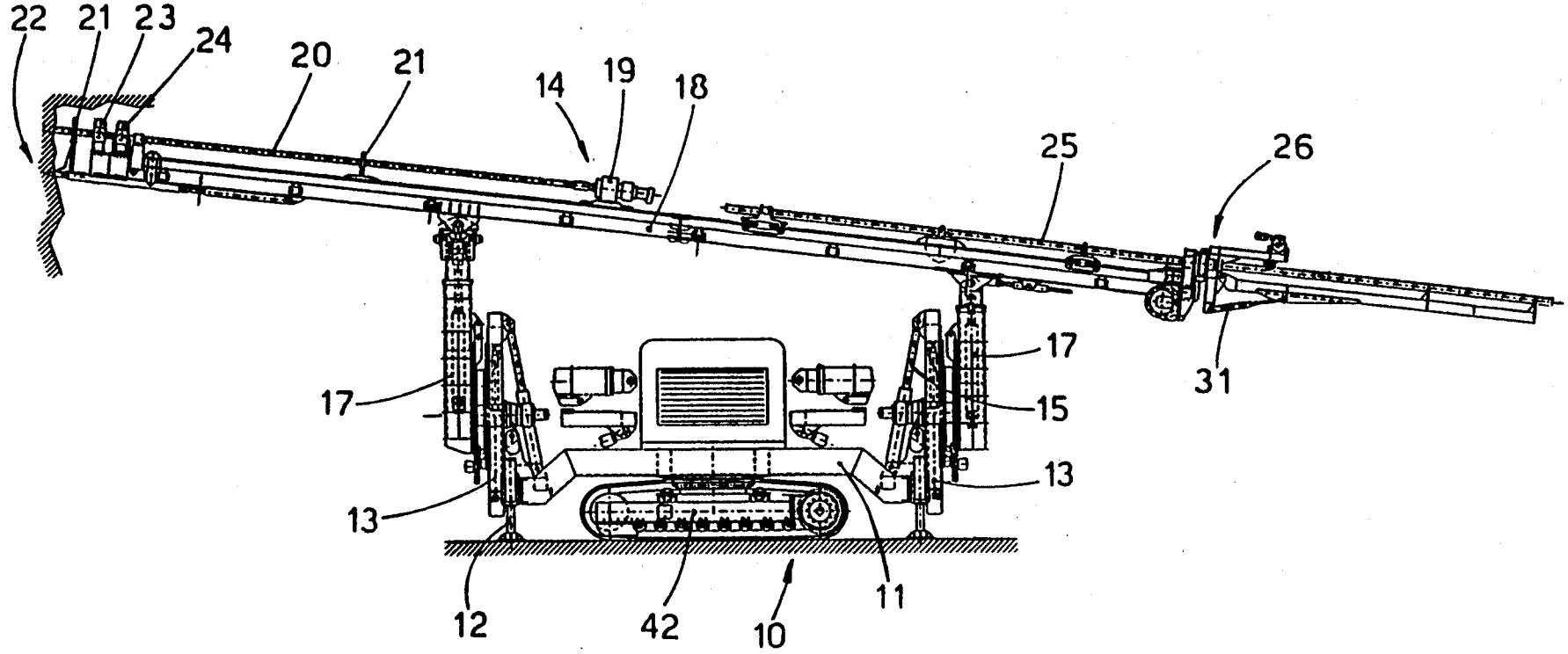
FIG. 1 gives a side view of an operating machine of the type described in a parallel patent application in the name of the present applicant, the machine bearing an excavation equipment on which the device of the invention can be installed.
Figure 2:
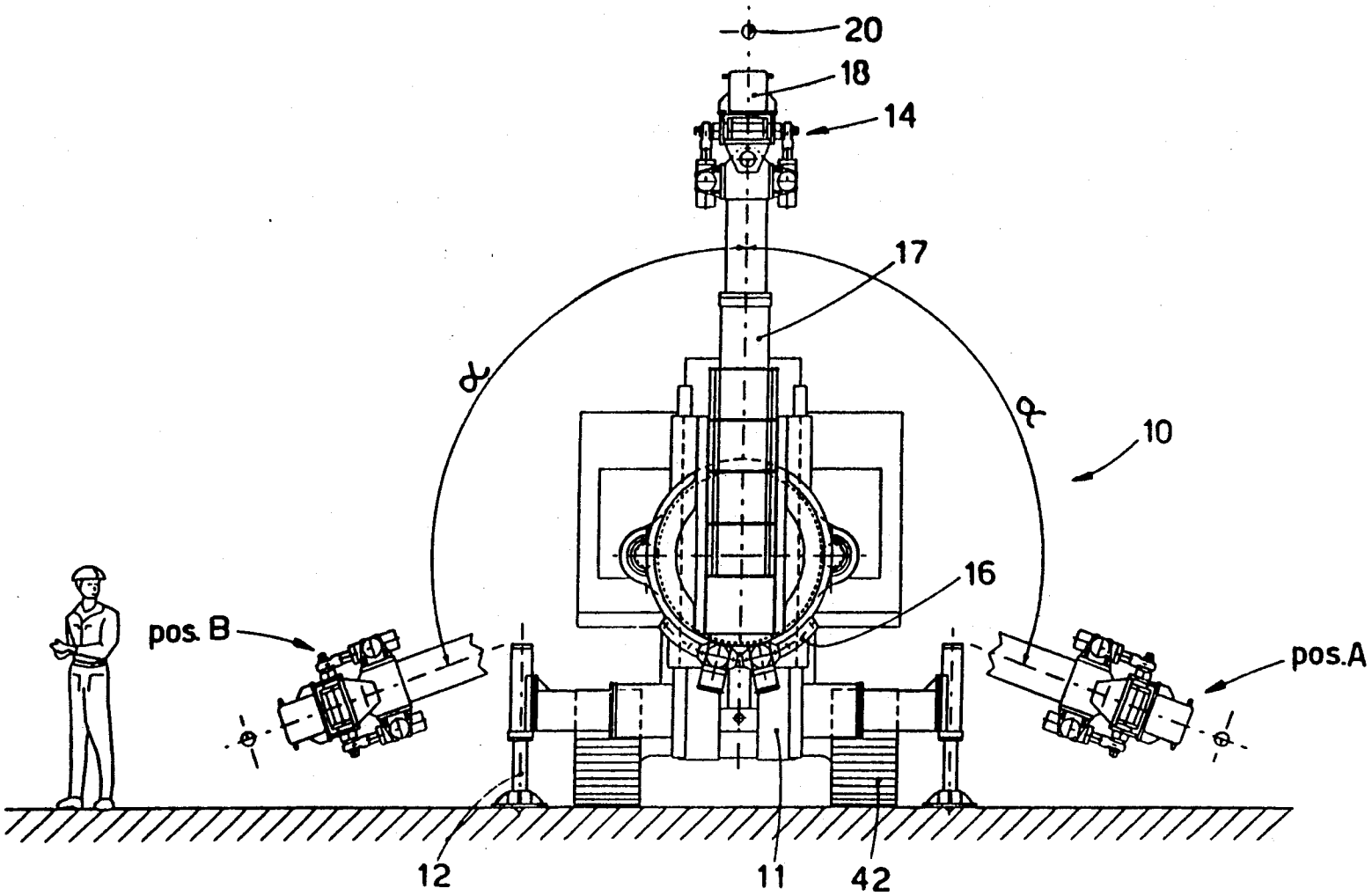
FIG. 2 is an enlarged front view of the machine of FIG. 1.

In FIGS. 1 and 2 a machine 10 to carry out lengthwise reinforcements in tunnels consists, in this example, of a tracked vehicle 42 equipped with a turret 11, which can be actuated to rotate continuously by 360° and is provided with stabilizers 12 for its level positioning.

A pair of structures 13 to support an excavation equipment 14 are hinged on the turret.

These support structures 13, which during movements of the vehicle 42 are folded into the overall profile of the vehicle 42 by jacks 15, comprise rotation thrust bearings 16 connected to telescopic columns 17.

The columns 17 bear at their ends the excavation equipment 14 and by means of the rotation thrust bearings 16 can 16 travel through an angle "alpha" (see FIG. 2) in relation to the vertical so as to cover the whole field of drilling.

The lowest positions A and B of the equipment 14 are those in which any work on the apparatus and drilling materials is carried out advantageously.

The excavation equipment 14 consists of a support 18 for a drilling head 19 able to run along the support 18.

The drilling head 19 is equipped in a known manner to actuate a drilling shaft 20 that cooperates with alignment guides 21 suitable to hold and align the shaft 20 on the drilling head 19.

At the end of the excavation equipment 14 on the side nearest to the excavation face 22 there are also comprised a first vice 23 to clamp the drilling shaft 20 or reinforcement rod 25 and a second vice 24 for the unscrewing of the drilling shaft 20.

Thus far we have described the operating machine 10, as specified above.

A device 26 to feed reinforcement rods 25, which is the subject of a parallel patent application of the present applicant, may be included at the end of the excavation equipment 14 farthest from the excavation face 22 and is secured to the excavation equipment 14.

Figure 3A:
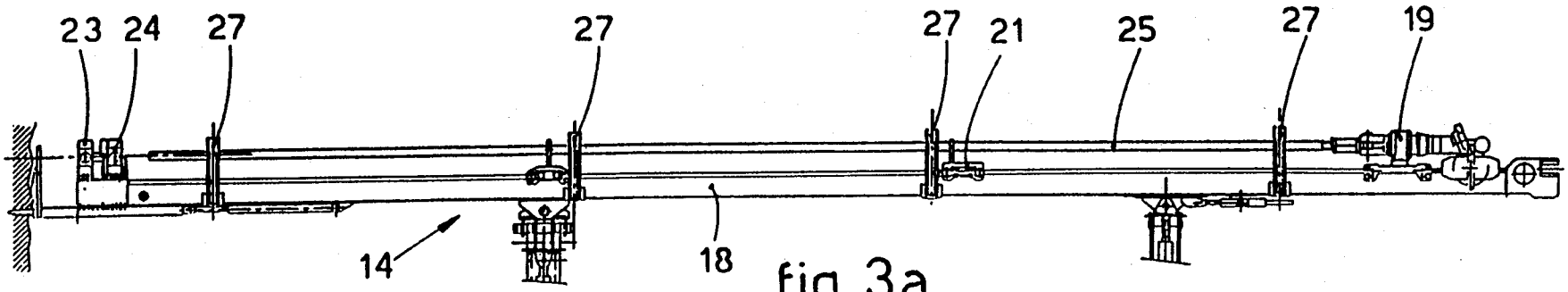
FIGS. 3*a* and 3*b* show two operating sequences in side views of the excavation equipment with the device of the invention fitted thereto.
Figure 3B:
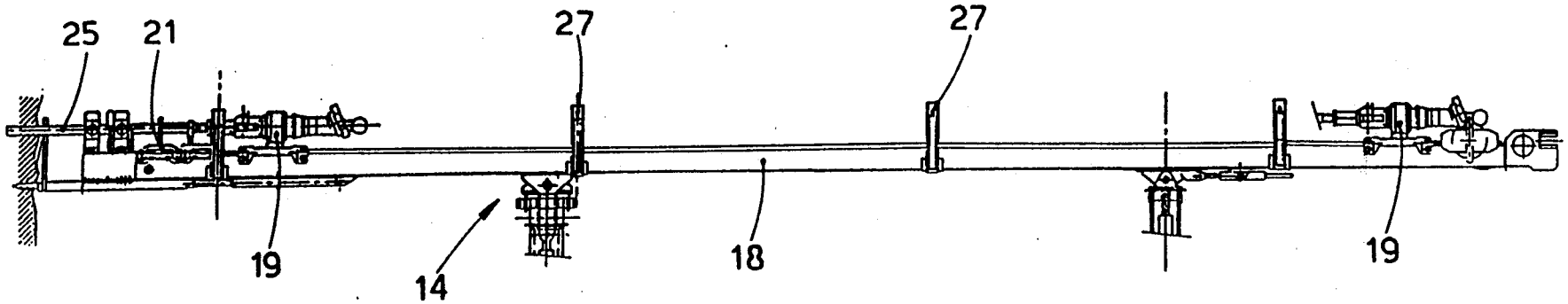

The device 26 may lift advantageously from the ground the reinforcement rod 25 and then thrust it forwards along the whole length of the excavation equipment 14, until the rod is positioned on the device 27 to load reinforcement rods and there awaits its employment (see FIGS. 3*a* and 3*b*).

In FIGS. 3*a* and 3*b* the device 27 to load reinforcement rods consists of a plurality of equal elements spaced apart along the excavation equipment 14.

FIG. 3*a* shows the reinforcement rod 25 as it is positioned on the alignment guides 21 but might equally well show the drilling shaft 20 in the same position.

FIG. 3*b* shows two working positions; the lefthand part of the FIGURE indicates the position corresponding to the travel of introduction of the reinforcement rod 25 into the hole made by the drilling shaft 20 by means of the drilling head 19, whereas the righthand part of the figure shows the drilling head 19 after it has carried out its empty return travel so as to take again the drilling shaft 20 parked on the rod-loading device 27 and then to proceed to make a new hole.

Figure 4:
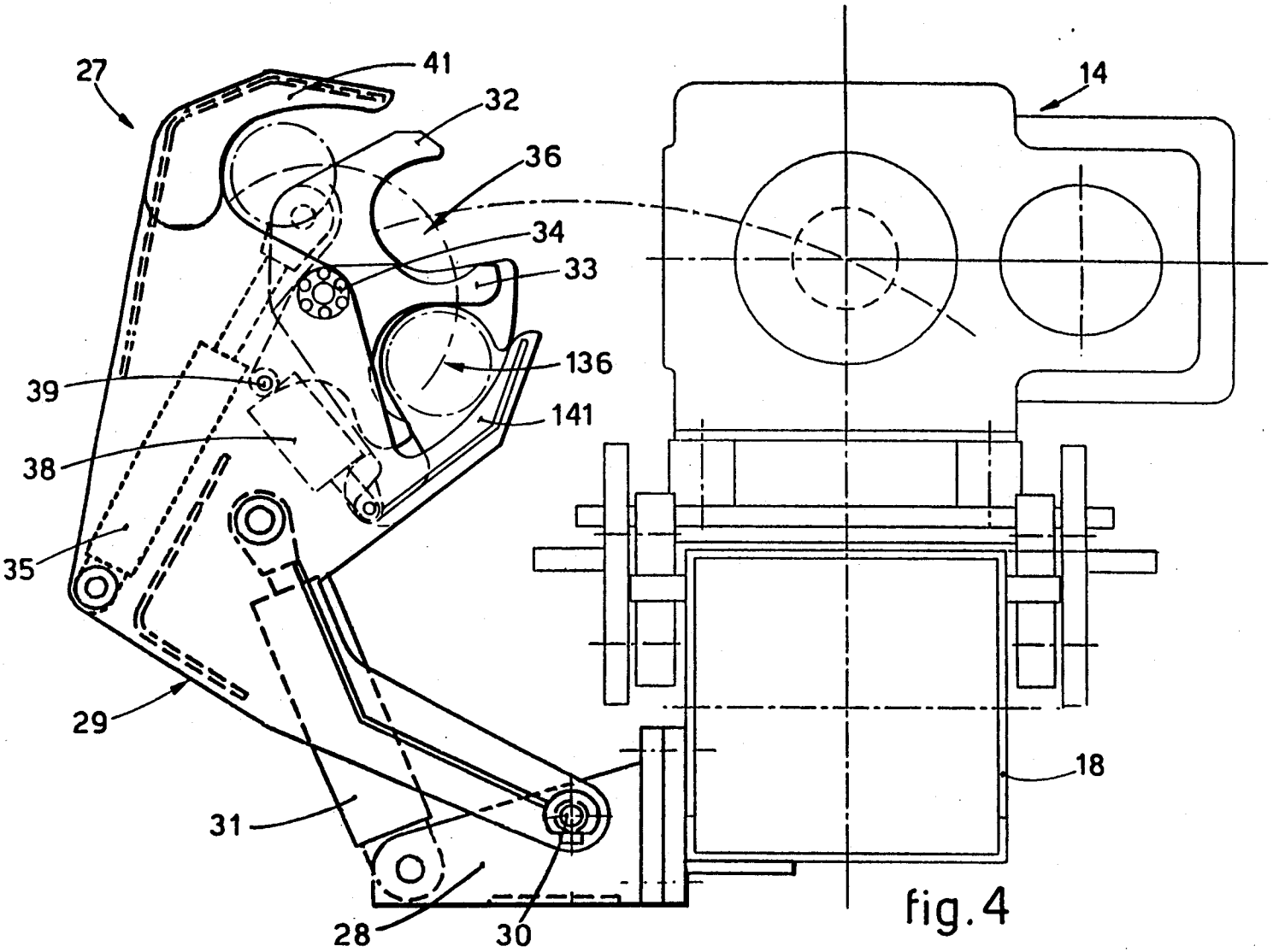
FIG. 4 gives a diagram of a side view of the device of the invention.
Figure 5:
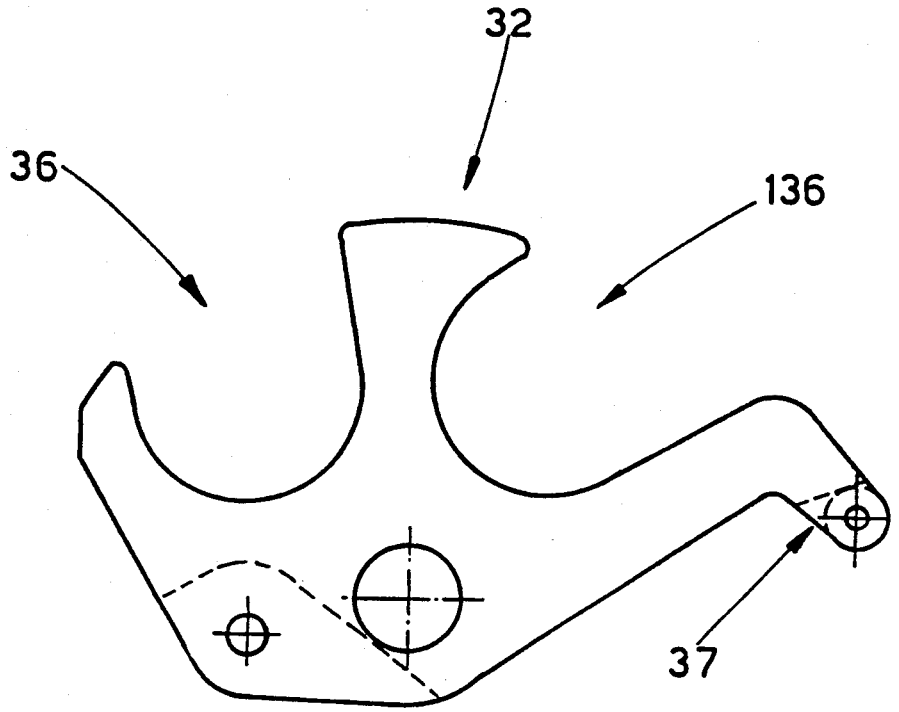
FIGS. 5 and 6 show details of the device of FIG. 4.
Figure 6:
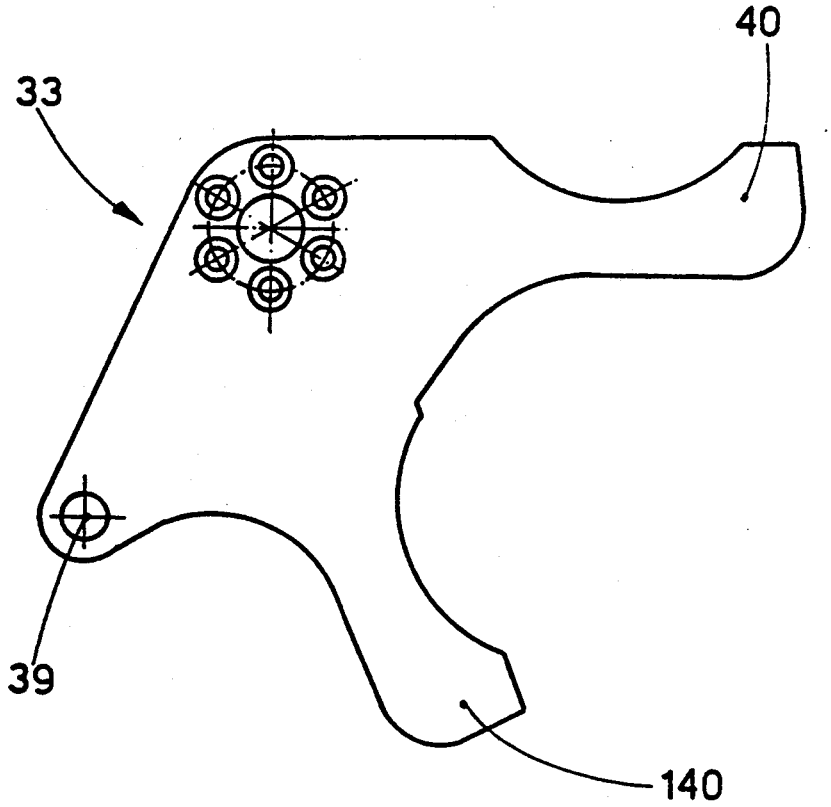

In FIGS. 4, 5 and 6 the device 27 to load reinforcement rods 25 consists of a support 28 for connection to the excavation equipment 14 and of a movable arm 29 pivoted at 30 on the support 28.

The arm 29 may be caused to oscillate about the pivot 30 by a suitable first actuation means, for instance a jack 31.

The movable arm 29 is a box-wise structure which can lodge within itself a shaped movable sector 32 and a pair of shaped clamping sectors 33.

The movable sector 32 can rotate about a pivot 34 in relation to the movable arm 29 and in this example is thus moved by a second jack 35 borne on the movable arm 29.

The movable sector 32 includes two notches 36–136 to lodge the reinforcement rod 25 and the drilling shaft 20 respectively.

The movable sector 32 is also provided with an element 37 to anchor at least an assembly that actuates the clamping sectors 33, this assembly being a third jack 38 for instance.

The clamping sectors 33 located on both sides of the movable arm 29 are connected to the third jack 38 at 39 and can rotate on the pivot 34 in relation to the movable arm 29 and the movable sector 32.

Each clamping sector 33 comprises clamping elements 40–140 which cooperate with the notches 36–136 of the movable sector 32 and with protrusions 41–141 of the movable arm 29 in the various working steps.

The sequence of working of the device 27 that loads reinforcement rods 25 is shown in FIGS. 7*a*–7*h*.

Figure 7A:
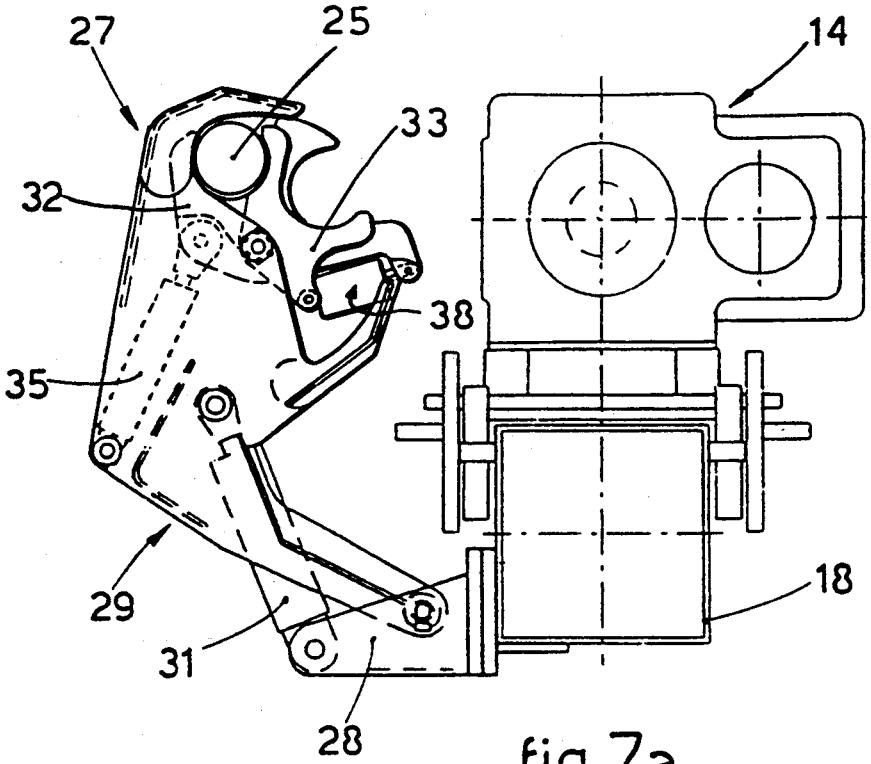
FIGS. 7*a*–7*h* show the various working steps of the device of FIG. 4.

FIG. 7*a* shows the device 27 of the invention with the reinforcement rod 25 in a waiting position. In this position the clamping sectors 33 are actuated and clamp the rod 25 in the notch 36.

Figure 7B:
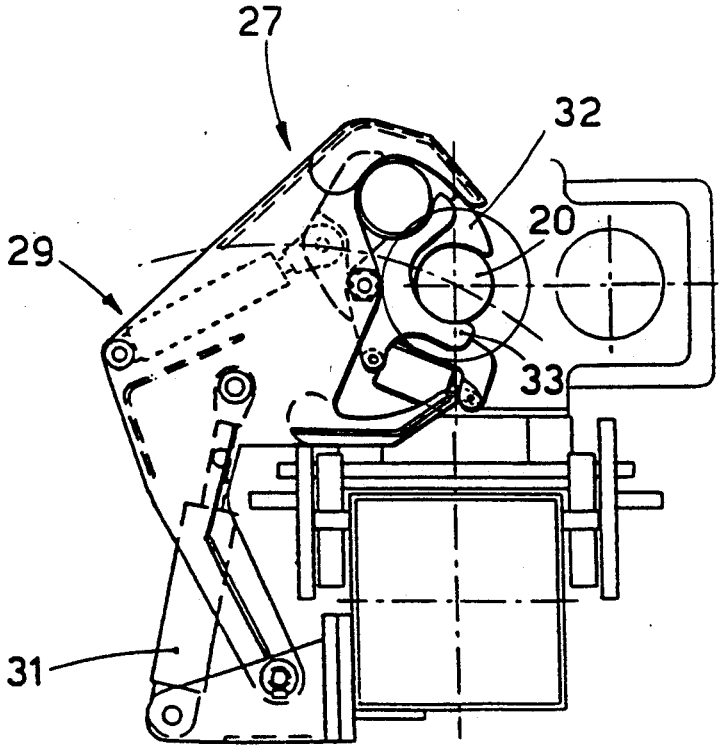

FIG. 7*b* shows the next step of taking the drilling shaft 20 from the drilling head 19 when the drilling of a hole has been completed and the cement agglomerate has been injected.

The movable arm 29 is rotated by the first jack 31 so as to bring the notch 136 of the movable sector 32 so as to correspond with the drilling shaft 20.

Figure 7C:
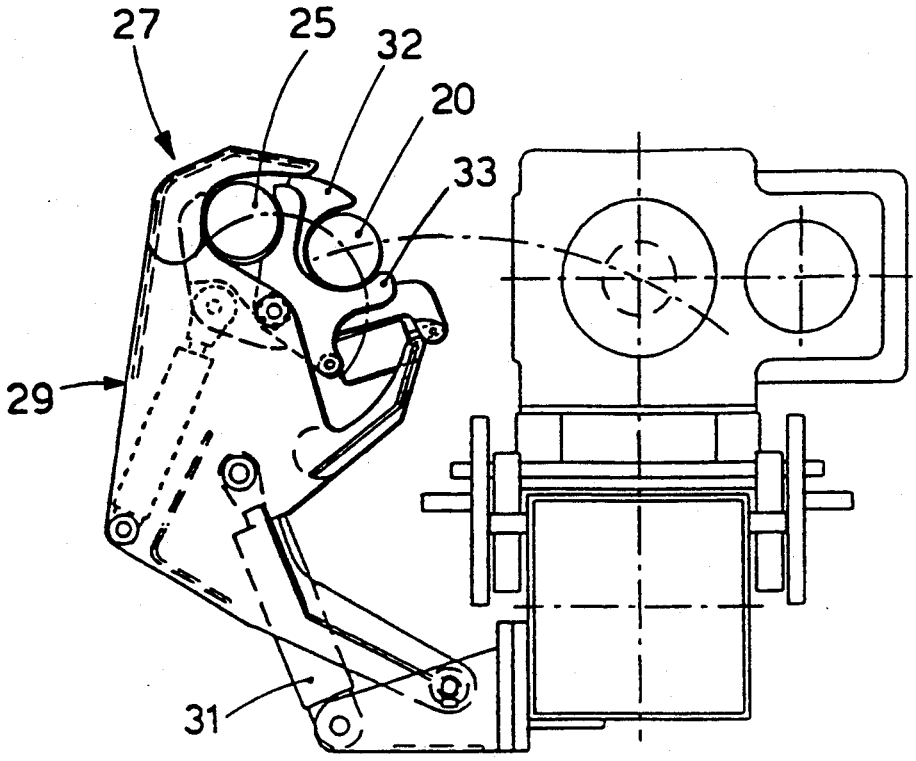

In FIG. 7*c* the movable arm 29 is brought back again by the first jack 31 to the position of FIG. 7*a*, having clamped the drilling shaft 20 between the movable sector 32 and the clamping sectors 33.

Figure 7D:
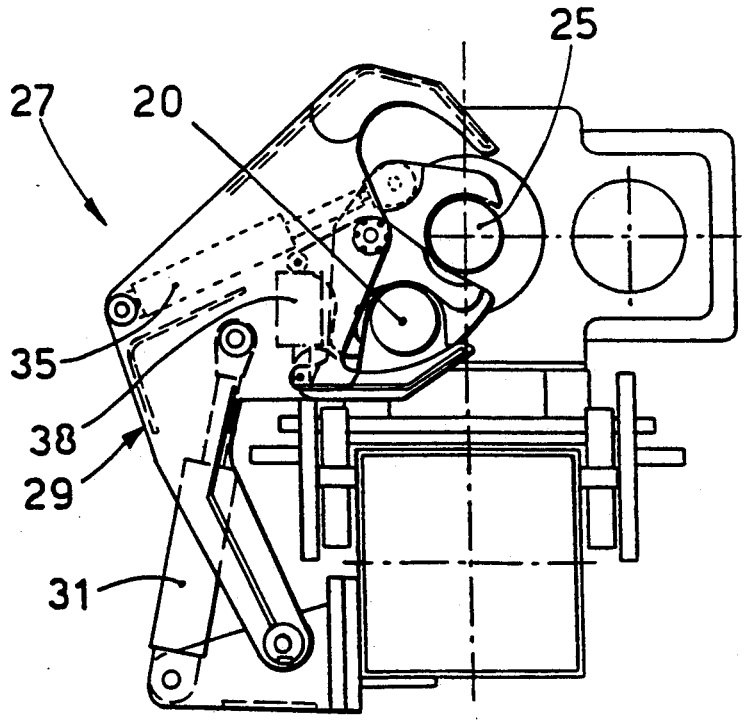

In FIG. 7*d* the movable arm 29 is brought back to the position of FIG. 7*b* by the first jack 31.

In this position the second jack 35 is actuated and brings the rod 25 to its position of engagement by the drilling head 19, which arranges to thrust it within the hole already drilled so as to complete the reinforcement.

In the position of FIG. 7*d* the third jack 38 too is actuated to free the reinforcement rod 25.

Figure 7E:
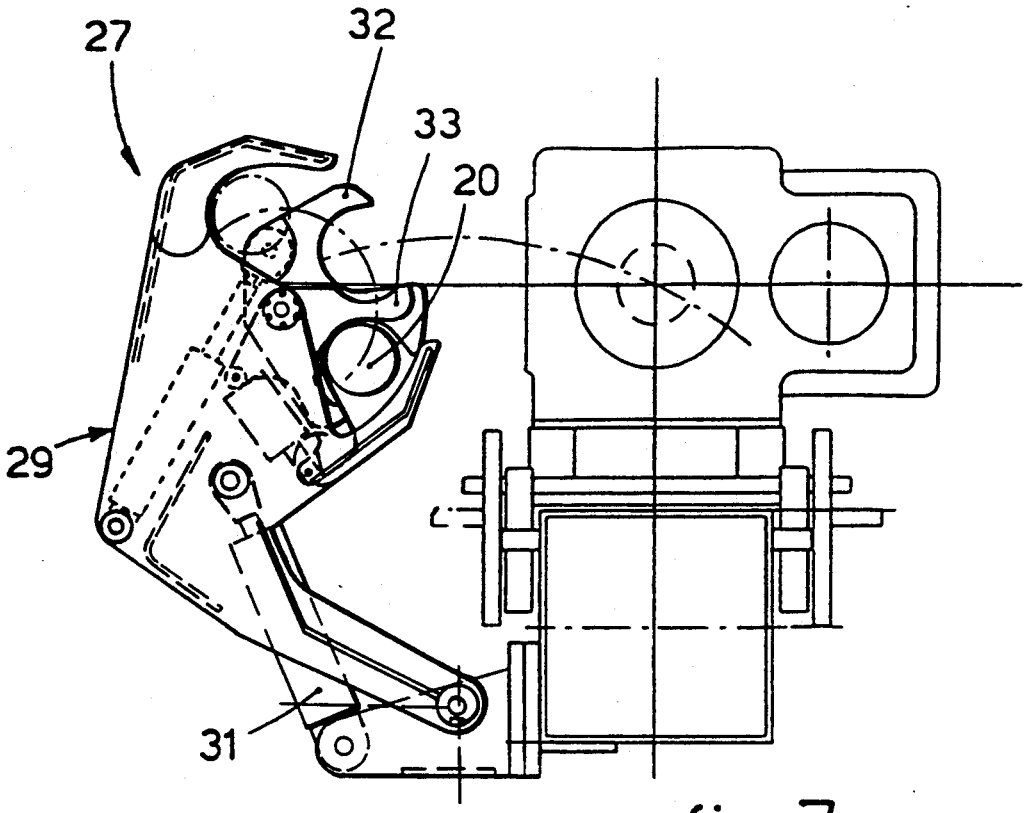
Figure 7F:
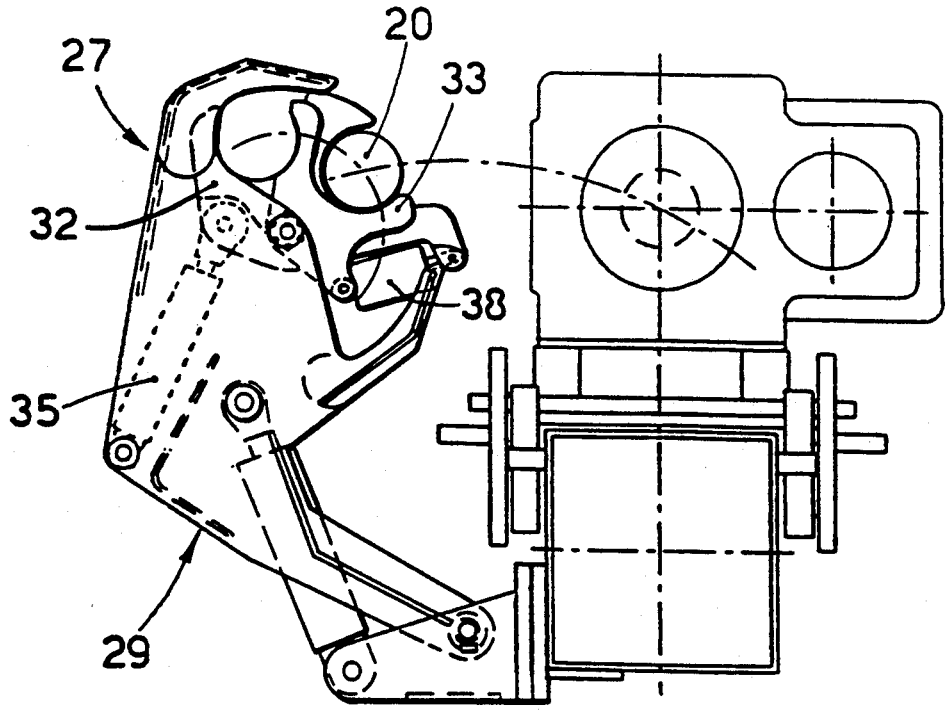

In FIG. 7*e* the first jack 31 is again re-actuated so as to bring the movable arm 29 back to the waiting position, whereas in FIG. 7*f* the second jack 35 is actuated so as to cause the movable sector 32 to rotate in the reverse direction to the rotation carried out beforehand in FIG. 7*d*.

In this position the third jack 38 is also actuated so as to clamp the drilling shaft 20, which now is located on its trajectory for loading into the drilling head 19.

Figure 7G:
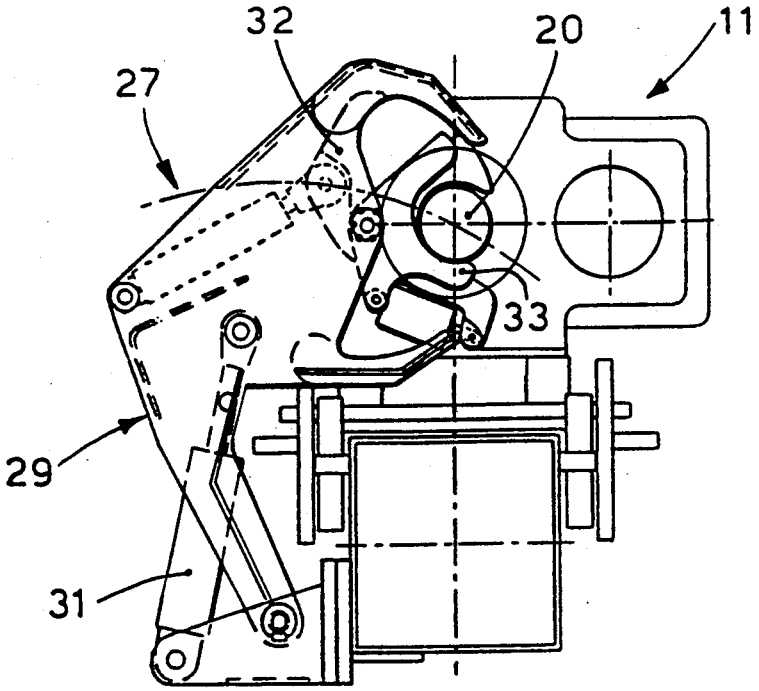

FIG. 7*g* in fact shows the step of loading the drilling shaft 20 onto the excavation equipment 14 by means, again, of the first jack 31 actuating the movable arm 29.

Figure 7H:
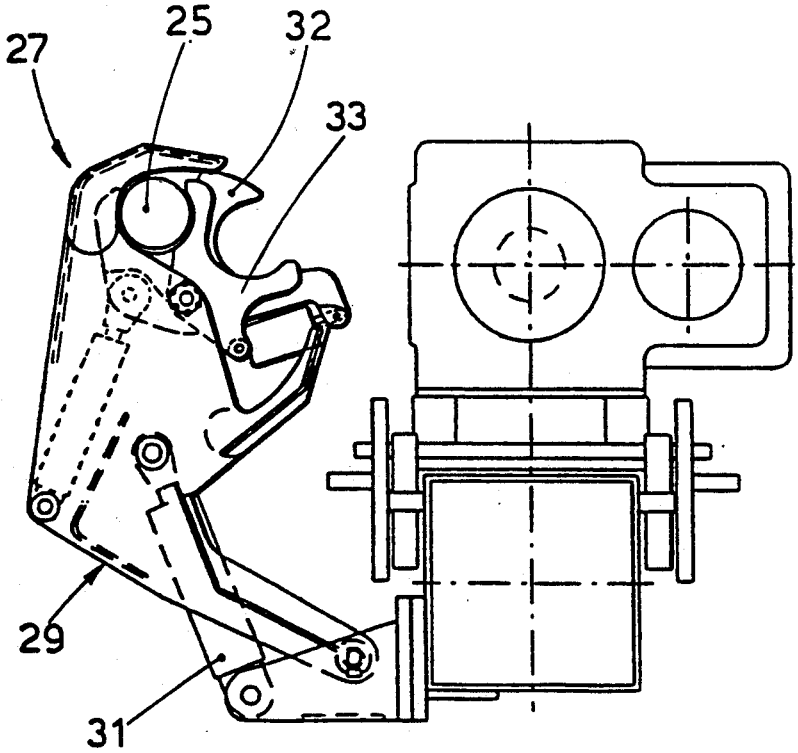

Lastly, FIG. 7*h* shows the same position as FIG. 7*a*, in which the device 27 is free to take a new reinforcement rod 25 and to begin a new working cycle as described above.

I claim:

1. A device for handling drill rods and reinforcing rods used in conjunction with excavation equipment, said excavation equipment being used to remove material from an excavation face of a tunnel being excavated, where such excavation equipment utilizes drilling equipment to drill holes along a drilling axis where upon reinforcing rods are subsequently inserted into said holes to provide lengthwise reinforcements in said tunnels, said drill rods and reinforcing rods extending to a length of about twenty meters, and said excavation equipment is borne on an excavation machine, said excavation equipment including a drilling head means for cooperating with drill rods to drill said holes and cooperating with said reinforcement rods to insert said rods into said holes, said device comprising;

a plurality of arm support structures (28) connected to said excavation equipment;

a plurality of arms, each arm associated with a corresponding arm support structure, for selectively moving said drill rod and said reinforcement rod from stored positions to positions in alignment with said drilling head; and a plurality of bearing means, each bearing means associated with a corresponding arm and arm support structure, each said bearing means for pivotally mounting said arm on said arm support structure, said arm pivotally mounted for controlled movement between engaged and non-engaged positions with respect to said drill head, where each of said plurality of arms comprising:

an arm support (29);

a shaped sector (32), said sector including at least one aperture, said at least one aperture for engaging at least one of said drill rod and said reinforcing rod;

means for pivotally mounting said shaped sector on said arm support for movement between two sector positions where, when said support arm is in said engaged position, in one of said sector positions said at least one of said reinforcing rod and said drill rod is in an engaged position with said drill head and in said other sector position said at least one of said reinforcing rod and said drill rod is in a non-engaged position with said drill head;

actuator means (35) for moving said sector (32) between said two sector positions;

clamp sector means (33);

pivot means for mounting said clamp sector means for pivotal movement between a clamped position and an unclamped position with respect to said shape sector;

clamping actuator means (38) for moving said clamp sector means (33) between said clamped position and said unclamped position, wherein in said clamped position said clamp sector means clamps any drill rod and reinforcing rod in position in said at least one shaped sector aperture.

2. The device according to claim 1, wherein said clamp sector means comprises at least one pair of clamping elements, one of each pair located on one side of said shaped sector and the other of each pair on another side of said shaped sector, each clamp element cooperating with a respective aperture in said shaped sector to clamp at least one of said drill rod and said reinforcing rod in position in said respective aperture.

3. The device according to claim 1, wherein said shaped sector has at least two apertures.

4. The device according to claim 3, wherein said clamp sector means comprises at least two clamping elements, each clamp element cooperating with a respective aperture in said shaped sector to clamp any rod in position in said respective aperture.

5. The device according to claim 1, wherein said clamp actuator means connects said shape sector and said clamp sector means and comprises an actuator jack (38).

6. The device according to claim 1, wherein said arm support includes at least one retention protrusion (41–141), said at least one retention protrusion cooperating with said at least one aperture in said shaped sector to comprise a means for retaining one of said reinforcing rod and said drill rod located in said at least one aperture.

7. The device according to claim 4, wherein said arm support includes at least two retention protrusions (41–141), said at least two retention protrusions cooperating with said at least two apertures in said shaped sector to comprise a means for retaining a rod located in one of said at least two apertures when said shaped sector is in one of said sector positions and for retaining a rod located in another of said at least two apertures when said shaped sector is in the other of said sector positions.

* * * * *